US009310154B1

(12) United States Patent
Charpie, III

(10) Patent No.: US 9,310,154 B1
(45) Date of Patent: Apr. 12, 2016

(54) MORTAR BARREL ELEVATION SYSTEM

(71) Applicant: Charles F. Charpie, III, Sylvania, OH (US)

(72) Inventor: Charles F. Charpie, III, Sylvania, OH (US)

( * ) Notice: Subject to any disclaimer, the term of this patent is extended or adjusted under 35 U.S.C. 154(b) by 0 days.

(21) Appl. No.: 14/789,117

(22) Filed: Jul. 1, 2015

(51) Int. Cl.
*F41A 23/54* (2006.01)
*F41A 23/56* (2006.01)
*F41F 1/06* (2006.01)

(52) U.S. Cl.
CPC ..... *F41A 23/56* (2013.01); *F41A 23/54* (2013.01); *F41F 1/06* (2013.01)

(58) Field of Classification Search
CPC ..... F41A 23/52; F41A 23/54; F41A 23/56; F41A 27/08; F41A 27/14; F41A 27/16; F41F 1/06
USPC ..... 89/37.05, 37.07, 37.13, 40.02
See application file for complete search history.

(56) References Cited

U.S. PATENT DOCUMENTS 1,449,449 A * 3/1923 Sayres ..... F41F 1/00 89/37.05
1,491,855 A * 4/1924 Hall ..... F41A 27/24 89/37.05

FOREIGN PATENT DOCUMENTS

FR 783790 * 7/1935

* cited by examiner

*Primary Examiner* — Stephen M Johnson
(74) *Attorney, Agent, or Firm* — Charles F. Charpie, III

(57) ABSTRACT

A mortar barrel elevation system is provided. The mortar barrel elevation system includes an elevation rail attached to a framework. The elevation rail includes a plurality of apertures positioned to be spaced apart in an outward direction. A carriage assembly is configured to slidably seat on the elevation rail and further configured to attach to an aperture in the elevation rail. A yoke assembly is pivotally attached to the carriage assembly. The yoke assembly includes extension members configured to support a mortar barrel. Attaching the carriage assembly to apertures positioned in an increasing outward direction decreases a launch angle of the mortar barrel and attaching the carriage assembly apertures positioned in an increasing inward direction increases the launch angle of the mortar barrel.

20 Claims, 8 Drawing Sheets

MORTAR BARREL ELEVATION SYSTEM

BACKGROUND

A cannon is any apparatus that uses gunpowder and/or one or more other explosive-based propellants to launch a projectile. Cannons can be used to fire projectiles having different calibers and can be configured to fire the projectiles different distances (ranges). Cannons can be further configured to provide different rates of fire, different angles of fire, and utilize different levels of firepower. Different forms of cannon can combine and balance these attributes in varying degrees, depending on their intended use on the battlefield.

A mortar is a type of cannon configured to fire explosive projectiles known as (mortar) bombs at low velocities, short ranges, and with high-arcing ballistic-type trajectories. Since mortars fire with short, high-arcing ballistic trajectories, mortars were commonly referred to as "siege" weapons, meaning the high-arcing trajectory of the fired projectile carried the projectile high over walls and other fortifications. Vintage style mortars typically include a barrel contained within a rigid framework. The length of the barrel is typically short and is generally less than 15 times its caliber. In certain instances, mortars can be loaded from the exit end of the barrel (commonly referred to as a muzzle-loading barrel).

The trajectory of the projectile fired from a mortar is determined from several factors including the weight of the projectile, the amount and explosiveness of the propellant and the launch angle of the projectile. The launch angle of the projectile is determined by an angle formed between a longitudinal axis of the mortar barrel and a generally horizontal line. In certain instances, the launch angle of the projectile can be adjustable to vary the range of the fired projectile.

It would be advantageous if the launch angle of a mortar could be easily adjusted to make the mortar easier to use.

SUMMARY

The above objects as well as other objects not specifically enumerated are achieved by a mortar barrel elevation system. The mortar barrel elevation system includes an elevation rail attached to a framework. The elevation rail includes a plurality of apertures positioned to be spaced apart in an outward direction. A carriage assembly is configured to slidably seat on the elevation rail and further configured to attach to an aperture in the elevation rail. A yoke assembly is pivotally attached to the carriage assembly. The yoke assembly includes extension members configured to support a mortar barrel. Attaching the carriage assembly to apertures positioned in an increasingly outward direction decreases a launch angle of the mortar barrel and attaching the carriage assembly apertures positioned in an increasingly inward direction increases the launch angle of the mortar barrel.

According to this invention there is also provided a mortar having a mortar barrel elevation system. The mortar includes a framework and a barrel pivotally attached to the framework, the barrel is configured to fire a projectile. A mortar barrel elevation system is configured to support the barrel. The mortar barrel elevation system includes an elevation rail attached to the framework. The elevation rail includes a plurality of apertures positioned to be spaced apart in an outward direction. A carriage assembly is configured to slidably seat on a top surface of the elevation rail. The carriage assembly is further configured to attach to an aperture in the elevation rail. A yoke assembly is pivotally attached to the carriage assembly, the yoke assembly including extension members configured to support a mortar barrel. Attachment of the carriage assembly to apertures positioned in an increasingly outward direction decreases a launch angle of the mortar barrel and attachment of the carriage assembly apertures positioned in an increasingly inward direction increases the launch angle of the mortar barrel.

According to this invention there is also provided a method of changing the launch angle of a mortar barrel. The method includes the steps of providing a framework having an elevation rail, the elevation rail includes a plurality of apertures positioned to be spaced apart in an outward direction, seating an elevation assembly on the elevation rail in a slidable arrangement, the elevation assembly having a carriage assembly pivotably attached to a yoke assembly, the yoke assembly including extension members configured to support a mortar barrel, aligning the elevation assembly in a first aperture in the elevation rail to provide a first launch angle and sliding the elevation assembly along the elevation rail such that the elevation assembly aligns with a different aperture in the elevation rail to provide a second launch angle. Attachment of the elevation assembly to apertures positioned in an increasing outward direction decreases a launch angle of the mortar barrel and attachment of the elevation assembly to apertures positioned in an increasing inward direction increases the launch angle of the mortar barrel.

Various objects and advantages of the mortar barrel elevation system will become apparent to those skilled in the art from the following detailed description of the preferred embodiment, when read in light of the accompanying drawings.

DETAILED DESCRIPTION OF THE INVENTION

Figure 1:
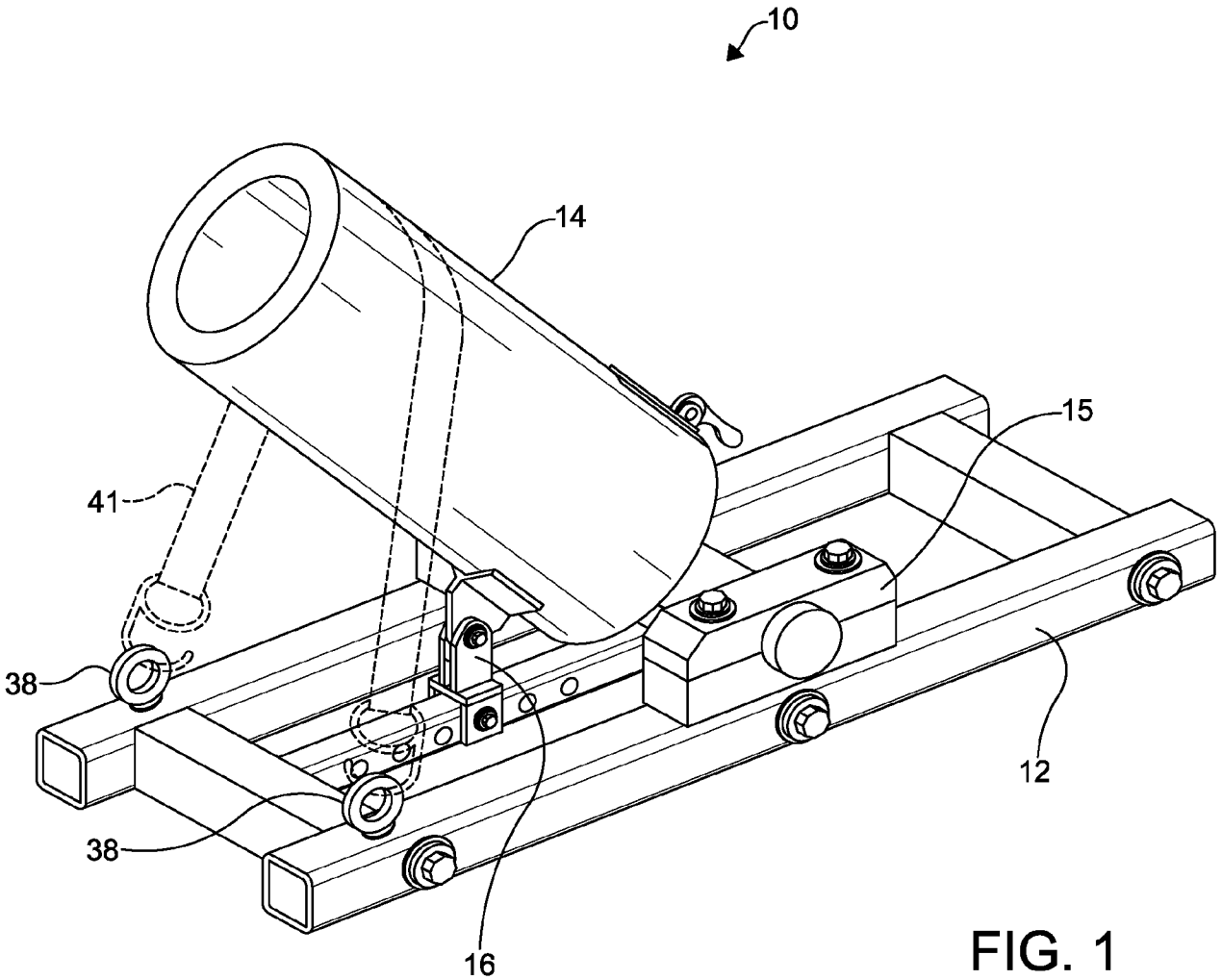
FIG. 1 is a perspective view of a mortar having a mortar barrel elevation system.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with illustrated embodiments of the present invention, the description and figures disclose a mortar barrel elevation system. The mortar barrel elevation system is configured to vary the launch angle of a mortar barrel, such as to vary the trajectory and/or range of a projectile fired from the mortar. The barrel of the mortar is equipped with an axle (or trunnion), thereby allowing the mortar barrel to pivotally assume different launch angles. The mortar barrel elevation system allows the mortar barrel to be quickly and easily adjusted from an initial launch angle to a subsequent desired launch angle.

The term "mortar", as used herein, is defined to mean any structure configured to launch a projectile from a barrel. The termu "barrel", as used herein, is defined to mean a tube-like structure, through which a deflagration or rapid expansion of gases are released in order to propel a projectile out of a muzzle end. The term "launch angle", as used herein, is defined to mean an angle formed between a longitudinal axis of the barrel and a plane having a generally horizontal orientation. The term "elevation system", as used herein is defined to mean structures and/or devices used to change and set the launch angle of the barrel.

Figure 2:
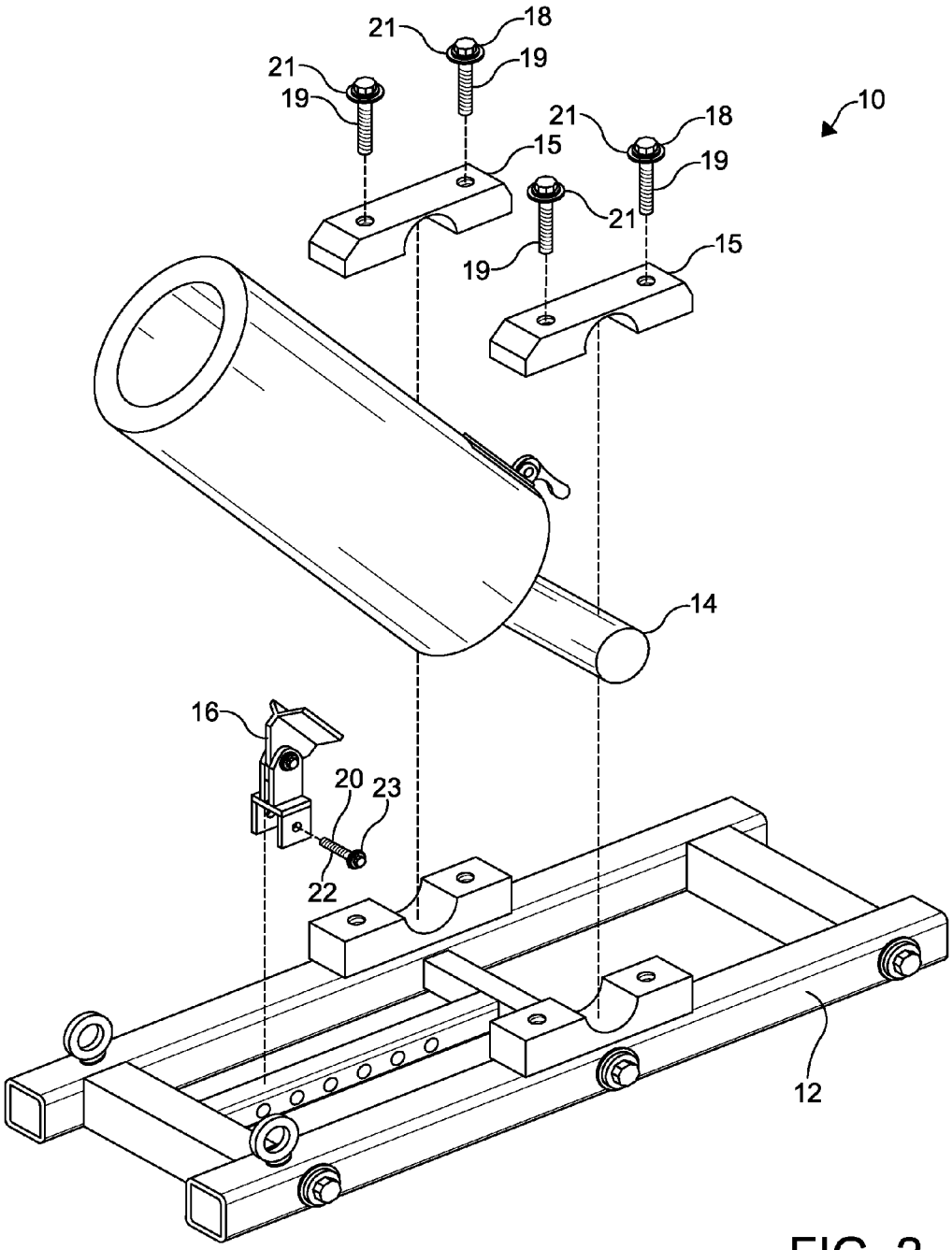
FIG. 2 is an exploded perspective view of the mortar of FIG. 1.

Referring now to FIGS. 1 and 2, a mortar is shown generally at 10. The mortar 10 includes a framework 12, a barrel assembly 14, a plurality of trunnion caps 15 and an elevation assembly 16. Using one or more explosive propellants (not shown), the mortar 10 is configured to fire a projectile (not shown) from a desired launch angle for a desired downfield trajectory and/or range.

Referring now to FIG. 2, the barrel assembly 14 pivotally seats on the framework 12 and is maintained in a pivotable, seated arrangement by the trunnion caps 15. The trunnion caps 15 are secured to the framework 12 by trunnion cap hardware 18. In the illustrated embodiment, the trunnion cap hardware 18 includes threaded bolts 19 and flat washers 21. Alternatively, other structures or devices can be used to secure the barrel assembly 14 to the framework 12 sufficient to maintain the barrel assembly 14 in a pivotable, seated arrangement.

Referring again to FIG. 2, the elevation assembly 16 slidably seats on a portion of the framework 12 and is maintained in a seated arrangement on the framework 12 by elevation assembly hardware 20. In the illustrated embodiment, the elevation assembly hardware 20 includes a threaded bolt 22 and a flat washer 23. Alternatively, other structures or devices can be used to secure the elevation assembly 16 to the framework 12 sufficient to maintain the elevation assembly 16 in a seated arrangement on the framework 12. Each of the framework 12, barrel assembly 14, trunnion caps 15 and the elevation assembly 16 will now be described in more detail.

Figure 3:
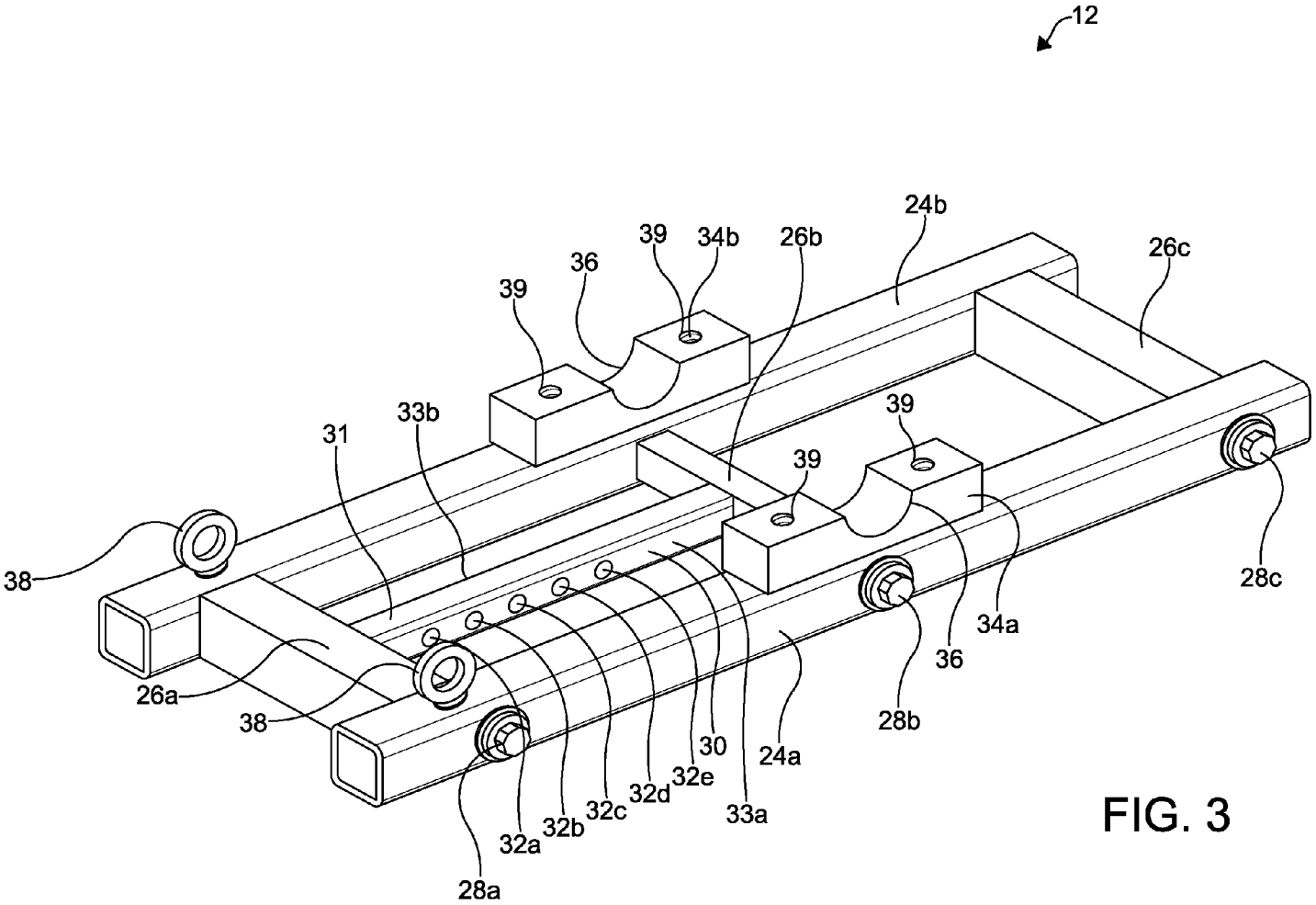
FIG. 3 is a perspective view of a framework forming a portion of the mortar of FIG. 1.

Referring now to FIG. 3, the framework 12 is illustrated. The framework 12 provides a support upon which the barrel assembly 14, trunnion caps 15 and the elevation assembly 16 are fitted. The framework 12 includes opposing rails 24*a*, 24*b* connected together by spaced apart cross members 26*a*-26*c*. In the illustrated embodiment, the rails 24*a*, 24*b* and the cross members 26*a*-26*c* are formed from 2.0 inch square steel tube having a 0.25 wall thickness. However, in other embodiments, the rails 24*a*, 24*b* and the cross members 26*a*-26*c* can be formed from other materials suitable to provide a support upon which the barrel assembly 14, trunnion caps 15 and elevation assembly 16 can be fitted, such as the non-limiting example of structural polymeric material. In the illustrated embodiment, the rails 24*a*, 24*b* and the cross members 26*a*-26*c* are connected together by welding. However, it is within the contemplation of the mortar 10 that the rails 24*a*, 24*b* and the cross members 26*a*-26*c* can be connected together by other methods, such as the non-limiting examples of brackets, clips and clamps.

Referring again to FIG. 3, optionally the framework 12 can include braces 28*a*-28*c* extending through the cross members 26*a*-26*c* and seated against exterior surfaces of the rails 24*a*, 26*b*. The braces 28*a*-28*c* are configured to span the framework 12 and provide structural support to the framework 12 as the mortar 10 is fired. In the illustrated embodiment, the braces 28*a*-28*c* are formed from threaded rod equipped with threaded fasteners at each end. In other embodiments, the braces 28*a*-28*c* can be formed from other structures, devices and mechanisms, such as for example clips and clamps, sufficient to provide structural support to the framework as the mortar 10 is fired. While the illustrated embodiment shows the braces 28*a*-28*c* as being positioned within interior passages of the cross members 26*a*-26*c*, in other embodiments the braces 28*a*-28*c* can be positioned in other locations sufficient to span the framework 12 and provide structural support to the framework 12 as the mortar 10 is fired. However, it should be appreciated that the braces 28*a*-28*c* are optional and not required for operation of the framework 12.

Referring again to FIG. 3, the framework 12 includes an elevation rail 30. The elevation rail 30 includes a top surface 31 connected to opposing side surface 33*a*, 33*b*. The elevation rail 30 is configured to support the elevation assembly 16. The elevation rail 30 is connected to and spans the cross members 26*a*, 26*b*. In the illustrated embodiment, the elevation rail 30 is formed from 1.0 inch square steel tube having a wall thickness of 0.25 inches. However, in other embodiments, the elevation rail 30 can be formed from other materials suitable to support the elevation assembly 16, such as for example the non-limiting example of structural polymeric materials.

Referring again to FIG. 3, the side surfaces 33*a*, 33*b* of the elevation rail 30 include a plurality of spaced apart, apertures 32*a*-32*e*. The apertures 32*a*-32*e* in the side surfaces 33*a*, 33*b* are aligned such that the threaded bolt 22 of the elevation assembly hardware 20 can extend through both side surfaces 33*a*, 33*b*. As will be explained in more detail below, the apertures 32*a*-32*e* are used to fasten the elevation assembly 16 to the elevation rail 30 at different points along the length of the elevation rail 30, thereby allowing the launch angle of the barrel assembly 14 to be adjusted. As shown in FIG. 3, aperture 32*a* is positioned at the farthest distance from the cross member 26*b* and aperture 32*e* being positioned at the closest distance from the cross member 26*b*. Apertures 32*b*-32*d* are positioned intermediate to the apertures 32*a* and 32*e*. In the illustrated embodiment, the apertures 32*a*-32*e* having a circular shape corresponding to the shape of the threaded bolt 22 and have a diameter of about 0.31 inches. Alternatively, the apertures 32*a*-32*e* can have other desired shapes and diameters sufficient to correspond to other fastening hardware.

Referring again to FIG. 3, the framework 12 includes trunnion supports 34*a*, 34*b* mounted to the rails 24*a*, 24*b*. The trunnion supports 34*a*, 34*b* are configured to receive the barrel assembly 14 and support the barrel assembly 14 in a pivotable, seated arrangement. The trunnion supports 34*a*, 34*b* include recesses 36 having a generally semi-circular cross-sectional shape corresponding to the cross-sectional shape of portions of the barrel assembly 14. However, in other embodiments, the trunnion supports 34*a*, 34*b* can include recesses having other cross-sectional shapes corresponding to the cross-sectional shape of portions of the barrel assembly 14, sufficient to support the barrel assembly 14 in a pivotable, seated arrangement.

Referring again to FIG. 3, optionally the rails 24*a*, 24*b* can include one or more support rings 38. As shown in FIG. 1, the support rings 38 are configured to receive one or more retaining members 41, configured to secure portions of the barrel assembly 14 against the elevation assembly 16. While the illustrated support rings 38 are positioned at an end of the rails 24*a*, 24*b* and have a substantially vertically orientated, circular shape, the support rings 38 can have any desired location and can have desired structure sufficient to receive retaining members 41 configured to secure portions of the barrel assembly 14. However, it should be appreciated that the support rings 38 are optional and not required for operation of the framework 12.

Referring again to embodiment illustrated in FIG. 1, the retaining member 41 is formed from an elastic tie-down strap and configured to flexibly secure portions of the barrel assembly 14 against the elevation assembly 16. It should be appreciated that at the moment of firing, the barrel assembly 14 may separate from the elevation assembly 16 due to recoil forces. However, the retaining member 41 is configured to return the barrel assembly 16 to a seated position against the elevation assembly 16.

Referring again to FIG. 3, the trunnion supports 34*a*, 34*b* include threaded apertures 39. The threaded apertures 39 are configured to threadably receive the threaded bolts 19 extending through the trunnion caps 15. In the illustrated embodiment, the threaded bolts 19 and the threaded apertures 39 have a ½ inch×13 thread pattern. However, in other embodiments, the threaded bolts 19 and the threaded apertures 39 can have other thread patterns sufficient to maintain the barrel assembly 14 in a pivotable, seated arrangement.

Figure 4:
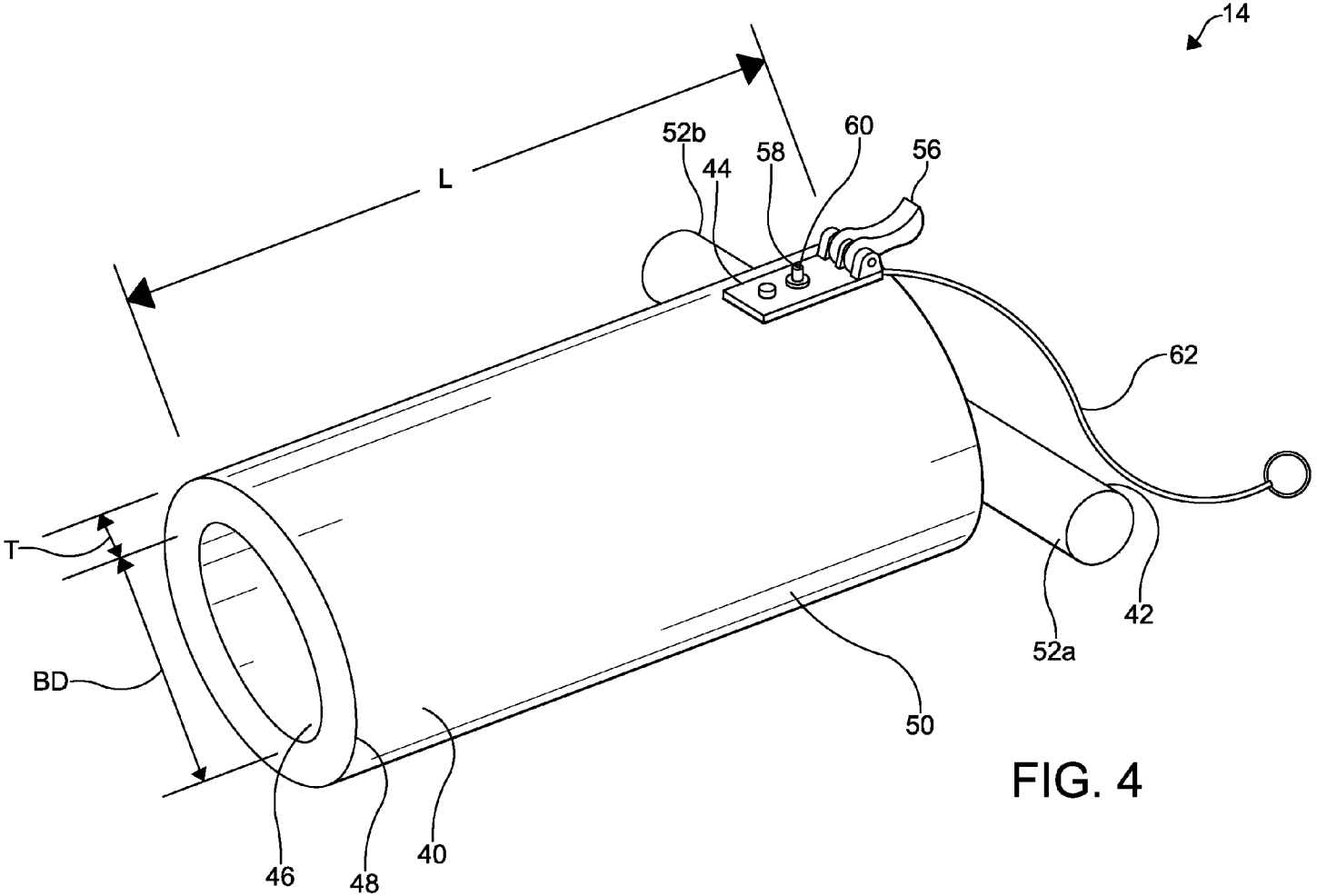
FIG. 4 is a perspective view of a barrel assembly forming a portion of the mortar of FIG. 1.

Referring now to FIG. 4, the barrel assembly 14 is illustrated. The barrel assembly 14 includes a barrel 40, a trunnion 42 and an ignition system 44. The barrel 40 includes a bore 46 formed therein extending from a muzzle end 48 to a breech end 50. The barrel 40 is configured to receive an explosive propellant (not shown) and a projectile (not shown) loaded into the muzzle end 48 and further configured to contain a rapid expansion of gases produced by the propellant and used to propel the projectile out of the muzzle end 50 at a desired trajectory and/or velocity.

Referring again to FIG. 4, the barrel 40 has a length L, a bore diameter BD and a wall thickness T. In the illustrated embodiment, the length L is in a range of from about 11.0 inches to about 13.0 inches, the bore diameter BD is in a range of from about 3.0 inches to about 4.0 inches and the wall thickness is in a range of from about 0.75 inches to about 1.5 inches. However, in other embodiments, the length L can be less than about 11.0 inches or more than about 13.0 inches, the bore diameter BD can be less than about 3.0 inches or more than about 4.0 inches and the wall thickness T can be less than about 0.75 inches or more than about 1.5 inches. With the length L of the barrel 40 and the bore diameter BD in these specified ranges, the mortar 10 meets the typical guideline of having a length that is less than 15 times its caliber (bore diameter BD).

Referring again to FIG. 4, the trunnion 42 is attached to the breech end 50 of the barrel 40. The trunnion 42 is configured as a fixed shaft, thereby allowing the barrel assembly 14 to pivot within the recesses 36 of the trunnion supports 34*a*, 34*b* of the framework 12. By pivoting within the trunnion supports 34*a*, 34*b*, the barrel assembly 14 can be positioned at various launch angles. The trunnion 42 includes cylindrically-shaped protrusions 52*a*, 52*b* extending in a perpendicular direction from the barrel 40. The protrusions 52*a*, 52*b* having a generally circular cross-sectional shape corresponding to the recesses 36 in the trunnion supports 34*a*, 34*b*. However, in other embodiments, the protrusions 52*a*, 52*b* can have other cross-sectional shapes corresponding to the recesses in the trunnion supports 34*a*, 34*b*, sufficient to allow the barrel assembly 14 to pivot within the recesses 36 of the trunnion supports 34*a*, 34*b*.

While the embodiment of the barrel assembly 14 shown in FIG. 4 illustrates the trunnion 42 as being positioned at the breech end 50 of the barrel 40, it should be appreciated that in other embodiments, the trunnion 42 could be located in other locations relative to the barrel 40, such as the non-limiting example of an approximate midpoint along the length L of the barrel 40.

Referring again to FIG. 4, the ignition system 44 is attached to the barrel 40 and is configured to provide a means of ignition for the propellant contained within the bore 46 of a loaded barrel 40. The ignition system 44 is a conventional percussion cap-based system. Percussion cap-based ignition systems are known in the art and will only be briefly described herein. The system 44 employs a rotatable hammer 56 configured to strike a percussion cap (not shown) positioned on a percussion nipple 58. The percussion nipple 58 includes a passageway 60 configured to convey sparks emanating from the percussion cap into an aperture (not shown) within the barrel wall. The sparks are conveyed through the barrel wall to the propellant contained within the bore 46. The hammer 56 is rotated by a user-initiated means, such as for example, a draw string 62. While the embodiment shown in FIG. 4 illustrates use of a percussion cap-based ignition system 44, it should be appreciated that in other embodiments other ignition systems can be used, sufficient to ignite the propellant contained within the bore 46 of a loaded barrel 40.

Figure 5:
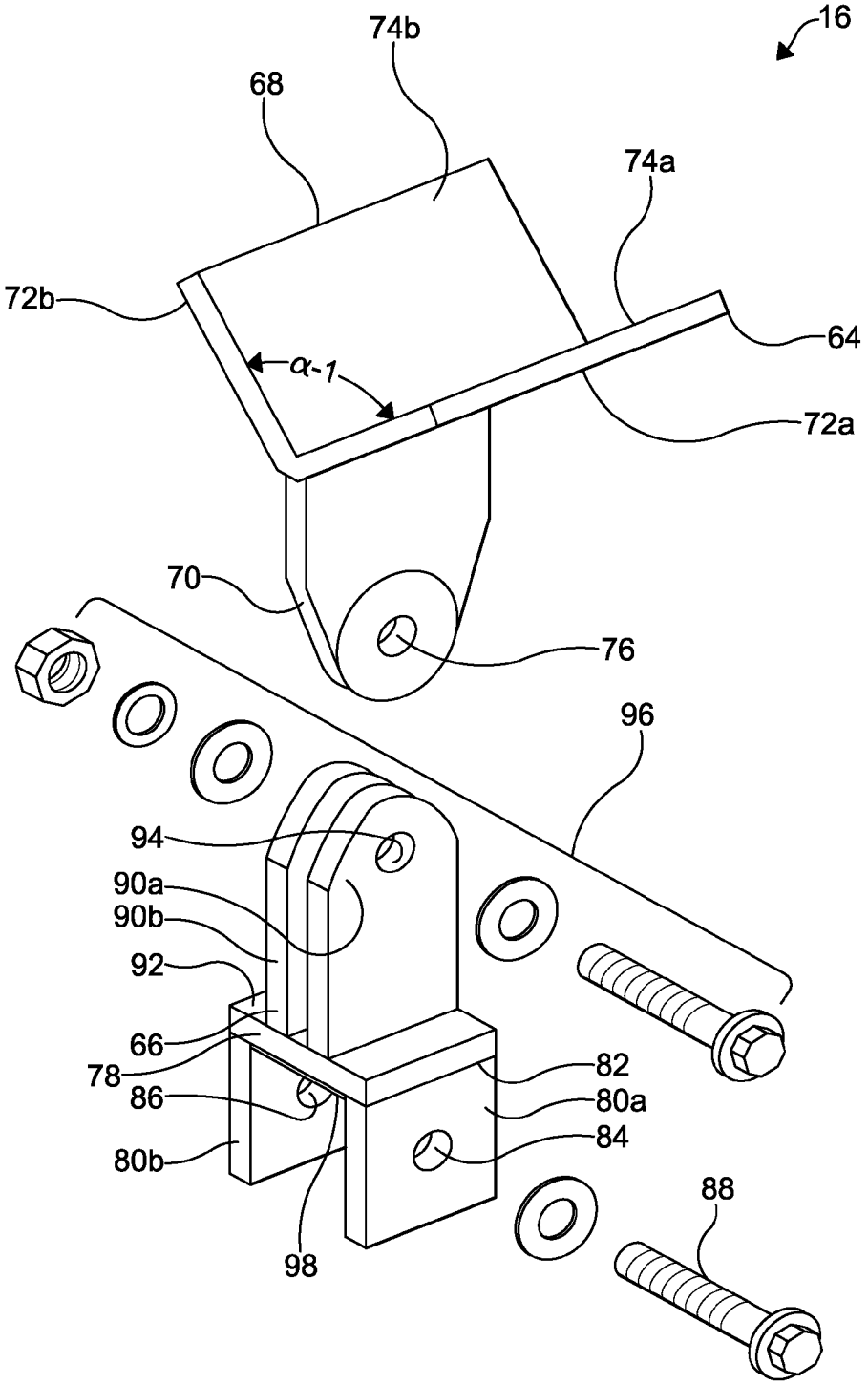
FIG. 5 is a perspective view of an elevation assembly forming a portion of the mortar of FIG. 1.

Referring now to FIG. 5, the elevation assembly 16 is illustrated. As will be explained in more detail below, the elevation assembly 16, when coupled with the elevation rail 30, provides a structure to vary the launch angle of the barrel assembly 14. The elevation assembly 16 includes a yoke assembly 64 pivotally mounted to a carriage assembly 66. The yoke assembly 64 includes a yoke 68 attached to a flange 70. The yoke 68 is formed with opposing extension members 72*a*, 72*b*, each having an upper surface 74*a*, 74*b*, respectively. The flange 70 extends from a bottom surface of the yoke 68 and includes an aperture 76 formed therethrough.

Referring again to FIG. 5, the extension members 72*a*, 72*b* form an angle α-1 therebetween. The angle α-1 is configured such that the extension members 72*a*, 72*b* span a distance of the barrel 40 to structurally support the barrel assembly 14. In the illustrated embodiment, the angle α-1 is in a range of from about 120° to about 150°. However, in other embodiments, the angle α-1 can be less than about 120° or more than about 150°, sufficient to span a distance of the barrel 40 to structurally support the barrel assembly 14.

Referring again to FIG. 5, the carriage assembly 66 is configured to slidably seat on the top surface 31 of the elevation rail 30 as shown in FIG. 3. The carriage assembly 66 includes a base member 78 and a plurality of parallel, spaced apart, opposing side members 80*a*, 80*b* connected to a lower surface 82 of the base member 78. The side members 80*a*, 80*b* extend in a generally downward direction from the base member 78 and are configured to guide the base member 78 as the base member 78 slidably seats on the elevation rail 30. Side member 80*a* includes a clearance aperture 84 and side member 80*b* includes a threaded aperture 86. The side members 80*a*, 80*b* are configured such that when the carriage assembly 66 is in a seated arrangement on the elevation rail 30, the apertures 84, 86 selectively align with one of the apertures 32*a*-32*c* in the elevation rail 30. A threaded fastener 88 extends through the clearance aperture 84 in the side member 80*a*, through one of the apertures 32*a*-32*e* in the elevation rail 30 and engages the threaded aperture 86 in the opposing side member 80*b*.

Referring again to FIG. 5, the carriage assembly 66 includes a plurality of parallel, spaced apart risers 90*a*, 90*b* connected to an upper surface 92 of the base member 78. The risers 90*a*, 90*b* extend in a generally upward direction from the base member 78 and are configured to engage the flange 70 extending from the yoke 68, such that the risers 90*a*, 90*b* are positioned adjacent opposing sides of the flange 70. Risers 90*a*, 90*b* each include a clearance aperture 94. The risers 90*a*, 90*b* are configured such that when the carriage assembly 66 is connected to the yoke assembly 64, the aperture 76 in the flange 70 aligns with the apertures 94 in the risers 90*a*, 90*b* and threaded hardware 96 is used to maintain the assembly. The threaded hardware 96 is further configured to allow the yoke assembly 64 and the carriage assembly 66 to pivot relative to each other about the aligned apertures 76, 94.

Referring again to FIG. 5, optionally the lower surface 82 of the base 78 can be fitted with a pad 98. The pad 98 is configured to facilitate sliding of the elevation assembly 16 on the top surface 31 of the elevation rail 30. In the illustrated embodiment, the pad 98 is formed from a material having a low coefficient of friction, such as for example, nylon or ultrahigh-molecular-weight polyethylene (UHMWPE). In other embodiments, the pad 98 can be formed from other materials, sufficient to facilitate sliding of the elevation assembly 16 on the top surface 31 of the elevation rail 30. However, it should be appreciated that the pad 98 is optional and not required for operation of the elevation assembly 16.

Figure 6:
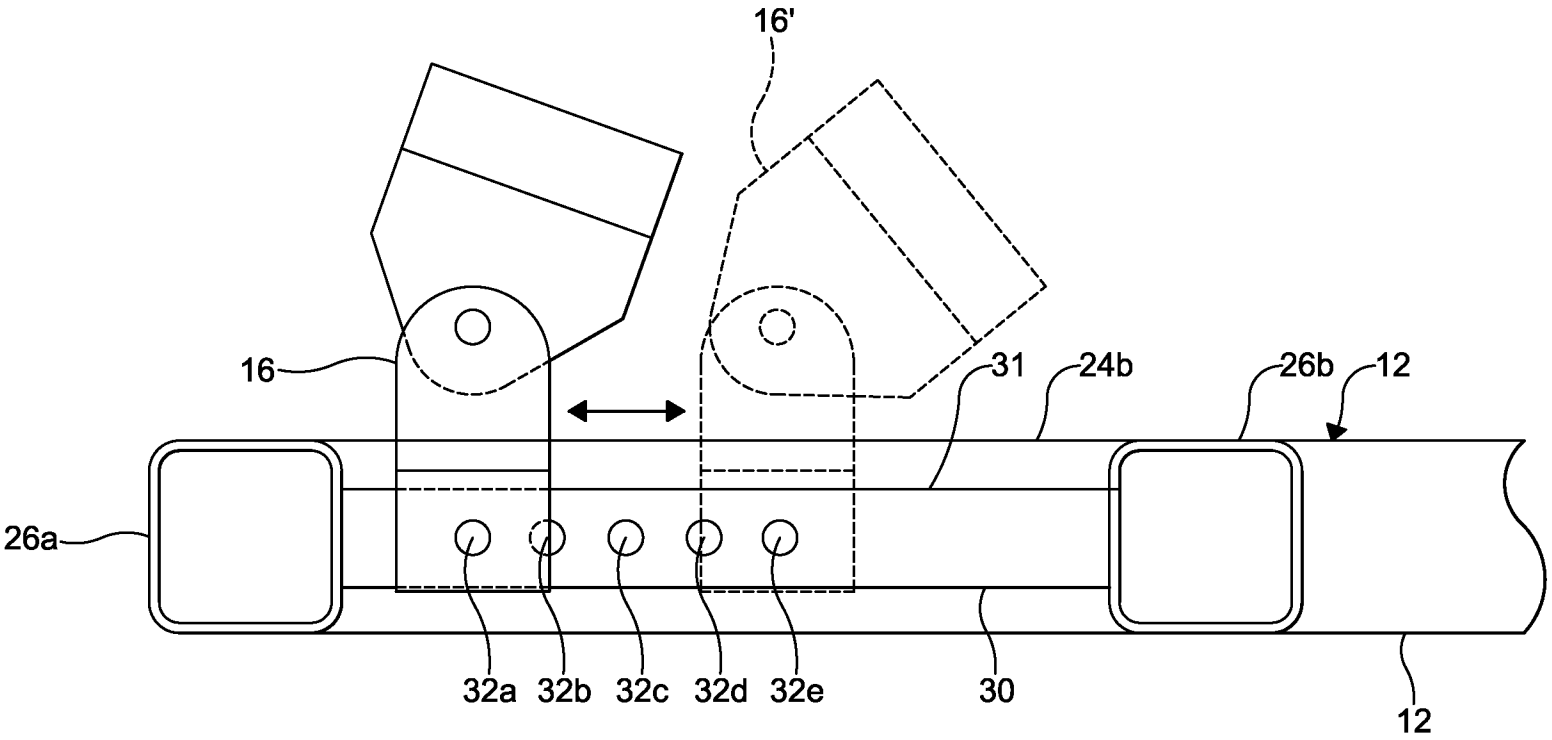
FIG. 6 is a side view, in elevation, of a portion of the mortar of FIG. 1 showing the elevation assembly forming different launch angles.
Figure 7:
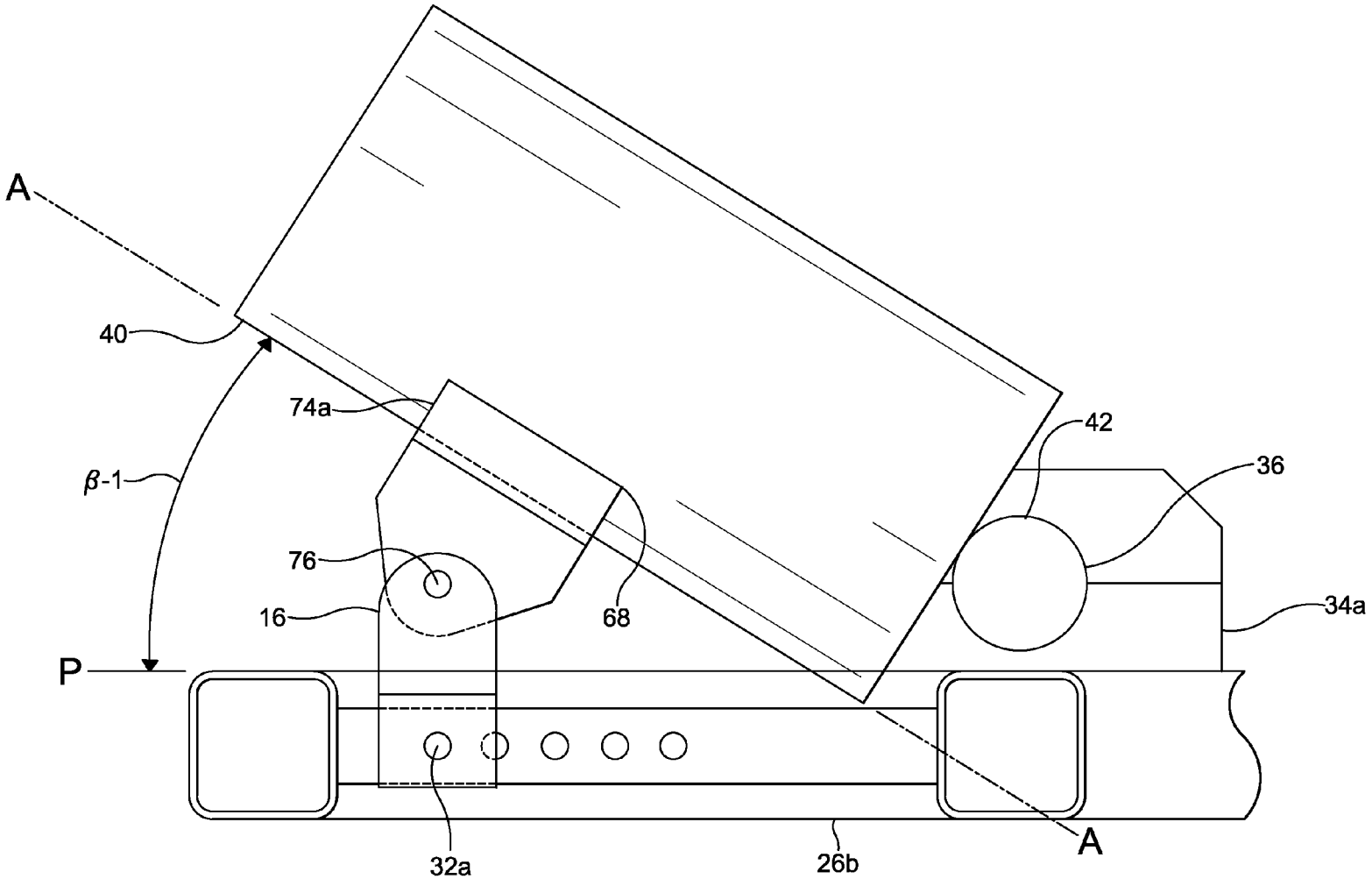
FIG. 7 is a side view, in elevation, of a portion of the mortar of FIG. 1 showing the elevation assembly positioned to form a first launch angle.

Referring now to FIG. 6, a cross-sectional view of a portion of the framework 12 and the elevation assembly 16 are shown. The framework 12 includes the rail 24*b*, the cross members 26*a*, 26*b* and the elevation rail 30. The elevation assembly 16 is shown in a seated arrangement on the top surface 31 of the elevation rail 30. The elevation rail 30 includes the apertures 32*a*-32*e*. The elevation assembly 16 is shown in a first position, aligned with aperture 32*a* of the elevation rail 30. Referring now to FIG. 7, with the elevation assembly 16 in this first position, the yoke 68 pivots about aperture 76 such that the upper surfaces 74*a*, 74*b* of the yoke 68 receive and support the barrel 40 as the trunnion 42 pivots within the recesses 36 of the trunnion supports 34*a*, 34*b*. A longitudinal axis A-A, defined by an outer surface of the barrel 40, forms a first launch angle β-1 with a plane P defined by the top surface of the rail 24*b*. In the illustrated embodiment, the first launch angle β-1 is about 25°. The first launch angle β-1 provides a fired projectile with a first, relatively low projectile trajectory.

Figure 8:
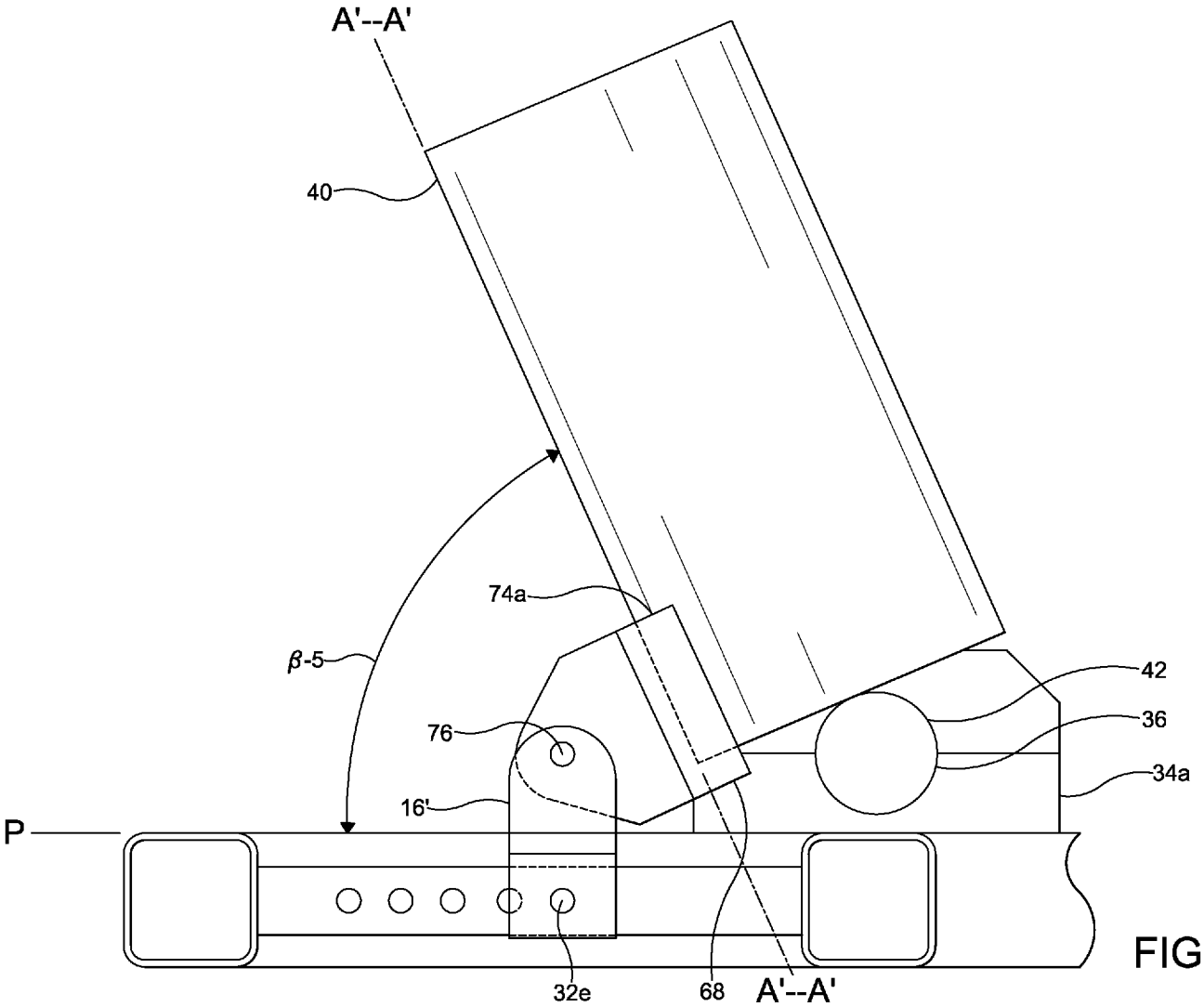
FIG. 8 is a side view, in elevation, of a portion of the mortar of FIG. 1 showing the elevation assembly positioned to form a different launch angle.

Referring again to FIG. 6, the elevation assembly 16' has been unfastened from the aperture 32*a* and the carriage assembly 66 has been slid along the top surface 31 of the elevation rail 31 until the carriage assembly 66 aligns with the aperture 32*e*. The elevation assembly 16' is fastened to aperture 32*e* of the elevation rail 30. Referring now to FIG. 8, with the elevation assembly 16' in this position, the yoke 68 pivots about aperture 76 such that the upper surfaces 74*a*, 74*b* of the yoke 68 receive and support the barrel 40 as the trunnion 42 pivots within the recesses 36 of the trunnion supports 34*a*, 34*b*. A longitudinal axis A'-A' defined by the outer surface of the barrel 40, forms a fifth launch angle β-5 with a plane P defined by the top surface of the rail 24*b*. In the illustrated embodiment, the fifth launch angle β-5 is about 65°. The fifth launch angle β-5 provides a fired projectile with a fifth, relatively high projectile trajectory.

Referring again to FIG. 6, in a similar manner, the elevation assembly 16 can be slid along the top surface 31 of the elevation rail 30 until the carriage assembly 66 aligns with the apertures 32*b*, 32*c* and 32*d*. The elevation assembly 16 can be fastened to apertures 32*b*, 32*c* and 32*d* of the elevation rail 30 as described above. In these positions, the yoke 68 can pivot about aperture 76 such that the upper surfaces 74*a*, 74*b* of the yoke 68 receive and support the barrel 40 as the trunnion 42 pivots within the recesses 36 of the trunnion supports 34*a*, 34*b*. With the elevation assembly 16 aligned with aperture 32*b*, a longitudinal axis defined by the outer surface of the barrel 40 forms a second launch angle of about 35° with a plane P defined by the top surface of the rail 24*b*, with the elevation assembly 16 aligned with aperture 32*c*, a longitudinal axis defined by the outer surface of the barrel 40 forms a third launch angle of about 45° and with the elevation assembly 16 aligned with aperture 32*d*, a longitudinal axis defined by the outer surface of the barrel 40 forms a fourth launch angle of about 55°. Accordingly, sliding the elevation assembly 16 along the top surface 31 of the elevation rail 30 from the most outward aperture 32*a* to more inward apertures has the effect of increasing the launch angle of the barrel 40. Conversely, sliding the elevation assembly 16 along the top surface 31 of the elevation rail 30 from the most inward aperture 32*e* to more outward apertures has the effect of decreasing the launch angle of the barrel 40.

While the description and figures provide the lowest launch angle of 25° and the highest launch angle of 65°, it should be appreciated that in other embodiments, the elevation assembly 16 and the elevation rail 30 can be configured to provide launch angles less than about 25° or more than about 65°.

While the description and figures provide for a quantity of five (5) apertures 32*a*-32*e* in the elevation rail 30, it should be appreciated that in other embodiments, more or less than five (5) apertures can be provided, with each aperture configured to provide a desired projectile launch angle.

While the description and figures show the apertures 32*a*-32*e* to be equally spaced apart to provide equal launch angle increments, it should appreciated that in other embodiments, the apertures 32*a*-32*e* can have any desired spacing to provide any desired launch angles.

The principle and mode of operation of the mortar barrel elevation system have been described in certain embodiments. However, it should be noted that the mortar barrel elevation system may be practiced otherwise than as specifically illustrated and described without departing from its scope.

What is claimed is:

1. A mortar barrel elevation system comprising:

an elevation rail attached to a framework, the elevation rail including a plurality of apertures positioned to be spaced apart in an outward direction;

a carriage assembly configured to slidably seat on a top surface of the elevation rail, the carriage assembly further configured to attach to an aperture in the elevation rail; and a yoke assembly pivotally attached to the carriage assembly, the yoke assembly including extension members configured to support a mortar barrel;

wherein attaching the carriage assembly to apertures positioned in an increasingly outward direction decreases a launch angle of the mortar barrel and attaching the carriage assembly apertures positioned in an increasingly inward direction increases the launch angle of the mortar barrel.

2. The mortar barrel elevation system of claim 1, wherein the elevation rail is attached to cross members forming a portion of the framework.

3. The mortar barrel elevation system of claim 1, wherein the carriage assembly includes side members extending to align apertures in the side members with the apertures in the elevation rail.

4. The mortar barrel elevation system of claim 3, wherein one of the apertures in the side members is threaded to receive a threaded bolt.

5. The mortar barrel elevation system of claim 1, wherein the carriage assembly includes risers extending to align an aperture in the risers with an aperture in the yoke assembly.

6. The mortar barrel elevation system of claim 1, wherein with the elevation assembly aligned with a most outwardly positioned aperture on the elevation rail, the mortar barrel forms a launch angle of about 25°.

7. The mortar barrel elevation system of claim 1, wherein with the elevation assembly aligned with a most inwardly positioned aperture on the elevation rail, the mortar barrel forms a launch angle of about 65°.

8. The mortar barrel elevation system of claim 1, wherein the apertures in the elevation rail are equally spaced apart.

9. The mortar barrel elevation system of claim 1, wherein the carriage assembly includes a pad configured to facilitate sliding of the elevation assembly on a top surface of the elevation rail.

10. A mortar having a mortar barrel elevation system, the mortar comprising:

a framework;

a barrel pivotally attached to the framework and configured to fire a projectile;

a mortar barrel elevation system configured to support the barrel, the mortar barrel elevation system comprising:

an elevation rail attached to the framework, the elevation rail including a plurality of apertures positioned to be spaced apart in an outward direction;

a carriage assembly configured to slidably seat on a top surface of the elevation rail, the carriage assembly further configured to attach to an aperture in the elevation rail; and a yoke assembly pivotally attached to the carriage assembly, the yoke assembly including extension members configured to support a mortar barrel;

wherein attaching the carriage assembly to apertures positioned in an increasingly outward direction decreases a launch angle of the mortar barrel and attaching the carriage assembly apertures positioned in an increasingly inward direction increases the launch angle of the mortar barrel.

11. The mortar of claim 10, wherein the elevation rail is attached to cross members forming a portion of the framework.

12. The mortar of claim 10, wherein the carriage assembly includes side members extending to align apertures in the side members with the apertures in the elevation rail.

13. The mortar of claim 12, wherein one of the apertures in the side members is threaded to receive a threaded bolt.

14. The mortar of claim 10, wherein the carriage assembly includes risers extending to align an aperture in the risers with an aperture in the yoke assembly.

15. The mortar of claim 10, wherein with the elevation assembly aligned with a most outwardly positioned aperture on the elevation rail, the mortar barrel forms a launch angle of about 25°.

16. The mortar of claim 10, wherein with the elevation assembly aligned with a most inwardly positioned aperture on the elevation rail, the mortar barrel forms a launch angle of about 65°.

17. The mortar of claim 10, wherein the apertures in the elevation rail are equally spaced apart.

18. A method of changing the launch angle of a mortar barrel, the method comprising the steps of:

providing a framework having an elevation rail, the elevation rail including a plurality of apertures positioned to be spaced apart in an outward direction;

seating an elevation assembly on the elevation rail in a slidable arrangement; the elevation assembly having a carriage assembly pivotably attached to a yoke assembly, the yoke assembly including extension members configured to support a mortar barrel;

aligning the elevation assembly in a first aperture in the elevation rail to provide a first launch angle; and sliding the elevation assembly along the elevation rail such that the elevation assembly aligns with a different aperture in the elevation rail to provide a second launch angle;

wherein attaching the elevation assembly to apertures positioned in an increasing outward direction decreases a launch angle of the mortar barrel and attaching the elevation assembly to apertures positioned in an increasing inward direction increases the launch angle of the mortar barrel.

19. The method of claim 18, wherein the elevation rail is attached to cross members forming a portion of the framework.

20. The method of claim 18, wherein with the elevation assembly aligned with a most outwardly positioned aperture on the elevation rail, the mortar barrel forms a launch angle of about 25°.

* * * * *